US005340194A

United States Patent [19]

Neumuller

[11] Patent Number: 5,340,194

[45] Date of Patent: Aug. 23, 1994

[54] DEVICE FOR ADJUSTING SEAT FRAME AND BACK REST OF CHAIR OF SWIVEL TYPE CHAIR

[75] Inventor: Konrad Neumuller, Burgthann, Fed. Rep. of Germany

[73] Assignee: Sifa Sitzfabrabrik GmbH, Sulzbach-Rosenberg, Fed. Rep. of Germany

[21] Appl. No.: 961,420

[22] Filed: Oct. 15, 1992

[30] Foreign Application Priority Data

Oct. 16, 1991 [DE] Fed. Rep. of Germany ... 9112861[U]

[51] Int. Cl.[5] ..... B60N 2/02

[52] U.S. Cl. ..... 297/304; 297/302; 297/374

[58] Field of Search ..... 297/304, 302, 301, 284.11, 297/374

[56] References Cited

U.S. PATENT DOCUMENTS

| | | | |
|---|---|---|---|
| 1,909,018 | 5/1933 | Sengpiel . | |
| 2,341,124 | 2/1944 | Sheldrick . | |
| 3,072,436 | 1/1963 | Moore | 297/304 |
| 4,832,402 | 5/1989 | Zünd | 297/302 |
| 4,909,472 | 3/1990 | Piretti | 297/302 |
| 4,943,115 | 7/1990 | Stucki | 297/302 |
| 4,966,411 | 10/1990 | Katagiri et al. | 297/304 |
| 5,224,758 | 7/1993 | Takamatsu et al. | 297/304 |

FOREIGN PATENT DOCUMENTS

| | | |
|---|---|---|
| 3500932A1 | 8/1985 | Fed. Rep. of Germany . |
| 3322450 | 10/1985 | Fed. Rep. of Germany . |
| 9109184 | 11/1991 | Fed. Rep. of Germany . |
| 3051224C2 | 12/1991 | Fed. Rep. of Germany . |

*Primary Examiner*—Peter M. Cuomo
*Assistant Examiner*—Darnell M. Boucher
*Attorney, Agent, or Firm*—George J. Brandt, Jr.

[57] ABSTRACT

A pedestal supported chair such as a swivel type chair in which a seat plate carrier pivoted to a base member fixed to the pedestal and having a back rest carrier is provided with adjustment means operable over range of user weights for adjusting a torsion spring mounted with its windings on the pivot by which the seat plate carrier is mounted to the base member. First legs of the spring member engage the seat plate carrier and second spring legs are connected to a holder supported from the base member. Rotation of a shaft passing through the holder moves the holder towards or away from the base member and results in greater or lesser tightening of the windings of the torsion spring to compensate in corresponding manner for the greater or lesser weight loadings which can be imposed on the seat plate carrier and on a chair back rest carrier when a user whose weight will be any one of such in a range of weights, sets a positioning relationship between the seat element and back rest and back rest intended to be that most comfortable to the user.

5 Claims, 2 Drawing Sheets

DEVICE FOR ADJUSTING SEAT FRAME AND BACK REST OF CHAIR OF SWIVEL TYPE CHAIR

BACKGROUND OF THE INVENTION

The present invention relates to the adjustment of chairs such as swivel type chairs and more particularly to adjustments made by individual users to set the relative positioning between a chair back rest and a chair seat element to the individual comfort of the user.

In a known type of office swivel chair, a base member is connected at a rear end thereof to a pedestal, the base having a forward part that includes a tip end to which a seat plate carrier is pivoted at a forward end of the latter. A back rest carrier can be either fixed rigidly or pivotally to the rear end of a seat plate carrier, and a spring can be interposed between the seat plate carrier and the base member to push the two apart. Means such as gas springs, clamping screws or a combination of a clamping means with lamination plates are used to lock the seat plate carrier and the back rest carrier relative to the base member.

In this type of chair, a user releases the locking means and moves the back rest and seat element (mounted on the seat plate carrier) in relation to each other by shifting the user's body weight as imposed on the seat element to effect what the user judges the most comfortable positioning of these components. However, body weight of users varies considerably and since this enters into the adjustment actually made since it is involved in how the seat plate carrier will slant or be angulated on the base member, the user following setting of the back rest/seat plate carrier relation by operating the locking means, may find that the slant of these to the base member does not provide the comfort sought.

To overcome this, an arrangement (disclosed in German published application DE 3500932) was proposed by which the force necessary for making slant adjustment could be adjusted according to the user's body weight. For the type chair described above, solution was offered in which a weight adjustment means comprised of an adjustable spring element be used. For this purpose, a spring was arranged with one end connected to a bar hanging from a pivot by which a base member was connected with a seat plate carrier, the other end of the spring being attached to the base member. The spring was activated by a knob running in a thread cut into the forward part of the bar. This arrangement was found not to be satisfactory because the adjustment range was very narrow and its effect when the user made back rest/seat element adjustment not readily discernible.

OBJECTS AND SUMMARY OF THE INVENTION

Accordingly, it is an object of the invention to provide a chair adjustment device for use where chair adjustments are made by users of varying weights which overcomes the drawbacks of the prior art.

It is a further object of the invention to provide a chair adjustment device embodying a spring adjustable over a range of spring tensionings against which a user who is of a weight in a range of such, makes seat/back rest adjustments.

It is a still further object of the invention to provide a chair adjustment device which is easily manipulated by the user and which is carried in unobtrusive mounting location on the chair.

Briefly stated, there is provided a pedestal supported chair such as a swivel type chair in which a seat plate carrier is pivoted to a base member fixed to the pedestal and having a back rest carrier. There also is provided adjustment means operable over a range of user weights for adjusting a torsion spring mounted with its windings on the pivot by which the seat plate carrier is mounted to the base member. First legs of the spring member engage the seat plate carrier and second spring legs are connected to a holder supported from the base member. Rotation of a shaft passing through the holder moves the holder towards or away from the base member and results in greater or lesser tightening of the windings of the torsion spring to compensate in corresponding manner for the greater or lesser weight loadings which can be imposed on the seat plate carrier and on a chair back rest carrier when a user whose weight will be any one of such in a range of weights, sets a positioning relationship between the seat element and back rest intended to be that most comfortable to the user.

In accordance with these and other objects of the invention, there is provided a chair frame which includes a base member fixed in an upright position at a rear end thereof to a vertical mounting pedestal, the base member having a front tip end in which a first end of an elongated seat plate carrier is pivoted. An opposite second end of the seat plate carrier locates proximal the base member rear end and a bias means such as a coil compression spring, engages with the base member and with the seat plate carrier urging the seat plate carrier upwardly of the base member to a normally generally horizontal dispositioning of the seat plate member. A back rest carrier having first and second opposite ends, has its first end connected to the second end of the seat plate carrier such as to be pivotable about an axis parallel to that about which the seat plate carrier can pivot, the second end of the back rest carrier mounting a chair back rest. Locking means comprising cooperating components carried on the seat plate carrier and the back rest carrier are provided and are operable in a locked condition thereof to lock the seat plate carrier to the back rest carrier whereby relative positioning between the back rest and a seat element carried on the seat plate carrier is a set relationship. The relative positioning between the back rest and seat element can be altered with the locking means in unlocked condition by pivoting the back rest carrier relative to the seat plate carrier and the seat plate carrier relative to the base member with a user imposed weight load presence acting on the seat element (and back rest). An adjustment device for compensating for a difference in pivoting effect produced on the seat plate carrier by different ones of user weights in a range of such is provided so that relative positioning between the back rest carrier and seat plate carrier can be effected to particular user comfort defined by the particular seat plate carrier and back rest carrier pivoting produced incident the particular user weight imposed presence on the seat element. This adjustment device comprises a torsion spring having plural windings about a shaft and at least one pair of oppositely directed legs connected to the windings. One leg of the pair is engaged with the seat plate holder and acts in opposition to pivoting of the seat plate holder toward the base member and a second leg of the pair is connected to a holder. The holder is supported from the base member so as to be moveable toward and away from the base member to correspondingly move the second leg in directions that produce respective greater or lesser tightening of the windings of the torsion spring whereby the said one leg of the torsion spring opposes seat plate holder pivoting toward the base member responsive to winding tightened condition.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

The adjusting device of the invention is used on office type chairs of the type wherein a seat back rest/seat element relative positioning is made by a user to suit the particular user comfort need and based on the user's particular body size and weight. Most commonly, the chair will be a swivel type but the construction to be detailed below need not be limited to that only as it can be used on chairs of other types as well.

Figure 1:
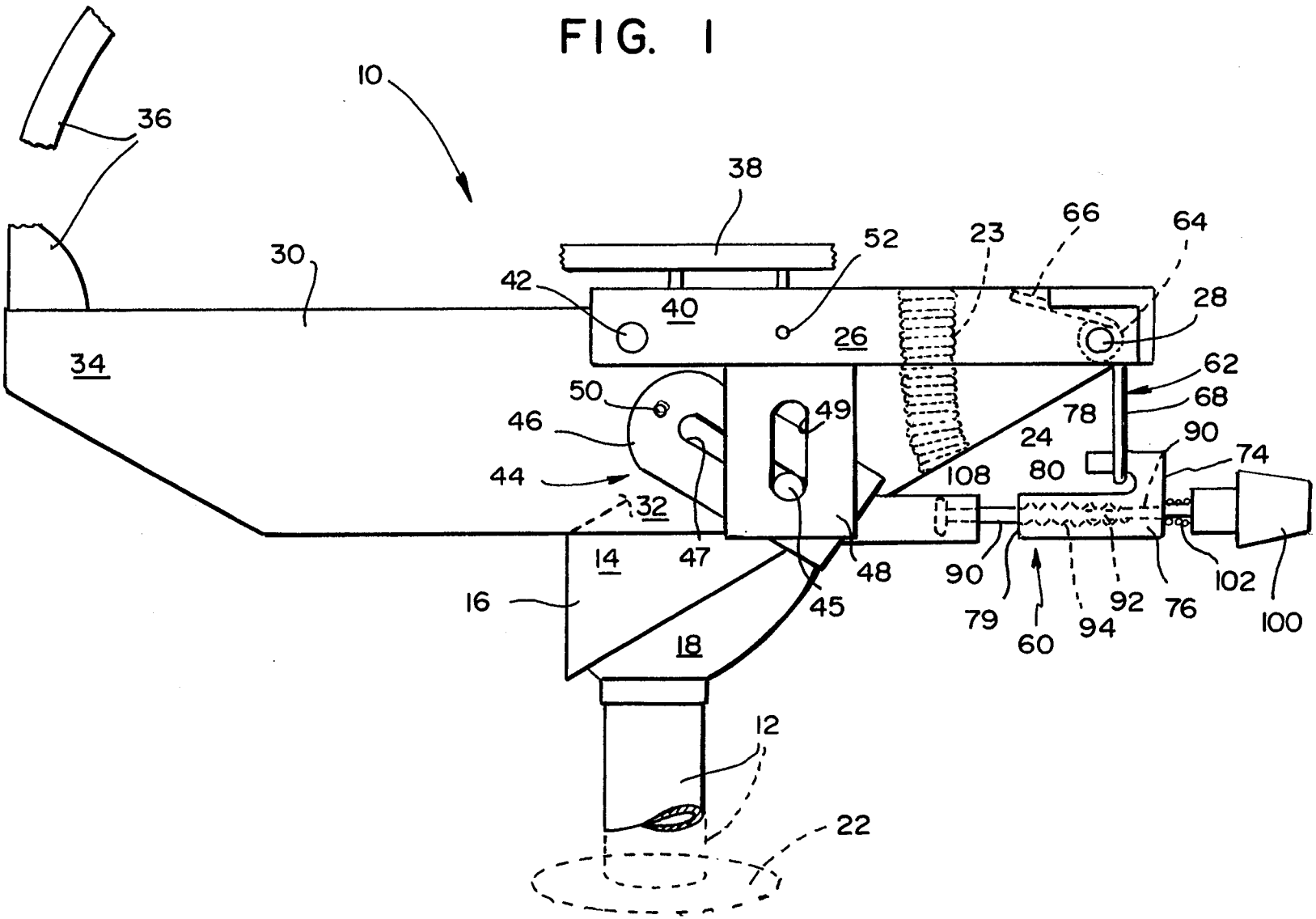
FIG. 1 is a side elevational view of a chair frame structure embodying a weight adjustment device for adjusting chair seat platforms and back rests and made in accordance with the invention.

Referring now to FIG. 1, there is depicted a chair frame 10 which includes a vertical pedestal 12 to the top of which is fixed as by welding, a base member 14, the fixing being to a rear end part 16 of the base member and through the intermediary presence of a base member reinforcement section 18. The pedestal 12 as seen, can be secured to and will be rotatable in a heavy floor piece 22 or in a floor unit of plural support legs.

Base member 14 is of an inverted channel section shape and generally triangular side profile, with the sides of its channel shape extending upwardly and forwardly to termination in a front tip end as at 24. A seat plate carrier 26 which also is of channel section, but with its side flanges pointed downward, is mounted at a first end thereof to a pivot or shaft 28 passing through the base member tip end, with the opposite second end of the seat plate carrier locating proximal the rear end part 16 of the base member 12. A coil type compression spring 23 is carried on the base member 14 and is secured at one end on web 19 (FIG. 3) of the base piece, the other end of the spring being engaged with the underside of the seat plate carrier 26.

Back rest carrier 30 also is of channel section and it is elongated having a first front end as at 32 proximal the seat plate carrier rear end, and a second rear end part 34 remote from both the seat plate carrier and the base member rear end part 16. Rear end part 34 mounts a chair back rest 36 only part of which is depicted as is the case with the seat element 38 carried on the seat plate carrier 26.

The opposite second end 40 of the seat plate carrier 26 is pivoted to the front end part 32 of the back rest carrier, this being by means of a pivot shaft 42 passing through both these components. As will be discerned from FIGS. 1 and 2, the arrangement of the above described components is such that the sides or flanges of the seat plate carrier gird or exteriorly embrace the outsides of the back rest carrier, and the sides of the back rest carrier exteriorly embrace the base member sides at least at the rear end part of the latter.

Certain relative movement of the back rest carrier and the seat plate carrier with respect to each other and to the fixed base member is possible. This movement occurs only when locking means carried on the chair frame are in unlocked condition, such locking means to be described next.

The locking means 44 is a component of known construction, for example, being of a type disclosed in U.S. Pat. No. 4,636,004, European published application EP 0 198 056 B1 as well is in other patents/applications so that the construction and operation of such locking means is well understood by one of ordinary skill in the art. Locking means 44 comprises two sets of lamination plates 46,48. One set, that is plates 46 which have slots 47, are mounted on a shaft 45 carried in the base member 14. These plates 44 also are pivoted on bolts 50 carried in the sides of the back rest carrier. The other lamination plates 48 also have slots 49 accommodating reception of these plates on the shaft 45 with these plates also being pivot mounted on bolts 52 carried in the sides or flanges of the seat plate carrier.

The locking means embodies clamping together features with actuation of control disc 54 in appropriate direction and this binds the seat plate carrier to the back rest carrier as a unit and with a given angulation of the seat plate carrier relative to the back rest carrier thereby being set. The angulation or slant that the seat plate carrier makes with the base member also would be set since the locking produces this too through the action of the laminations and the seat plate carrier and back rest carrier on each other. The locking means it is understood are unlocked for the user to effect seat back rest seat element adjustment and it is returned to locked condition by the user to set that adjusted relationship.

Figure 2:
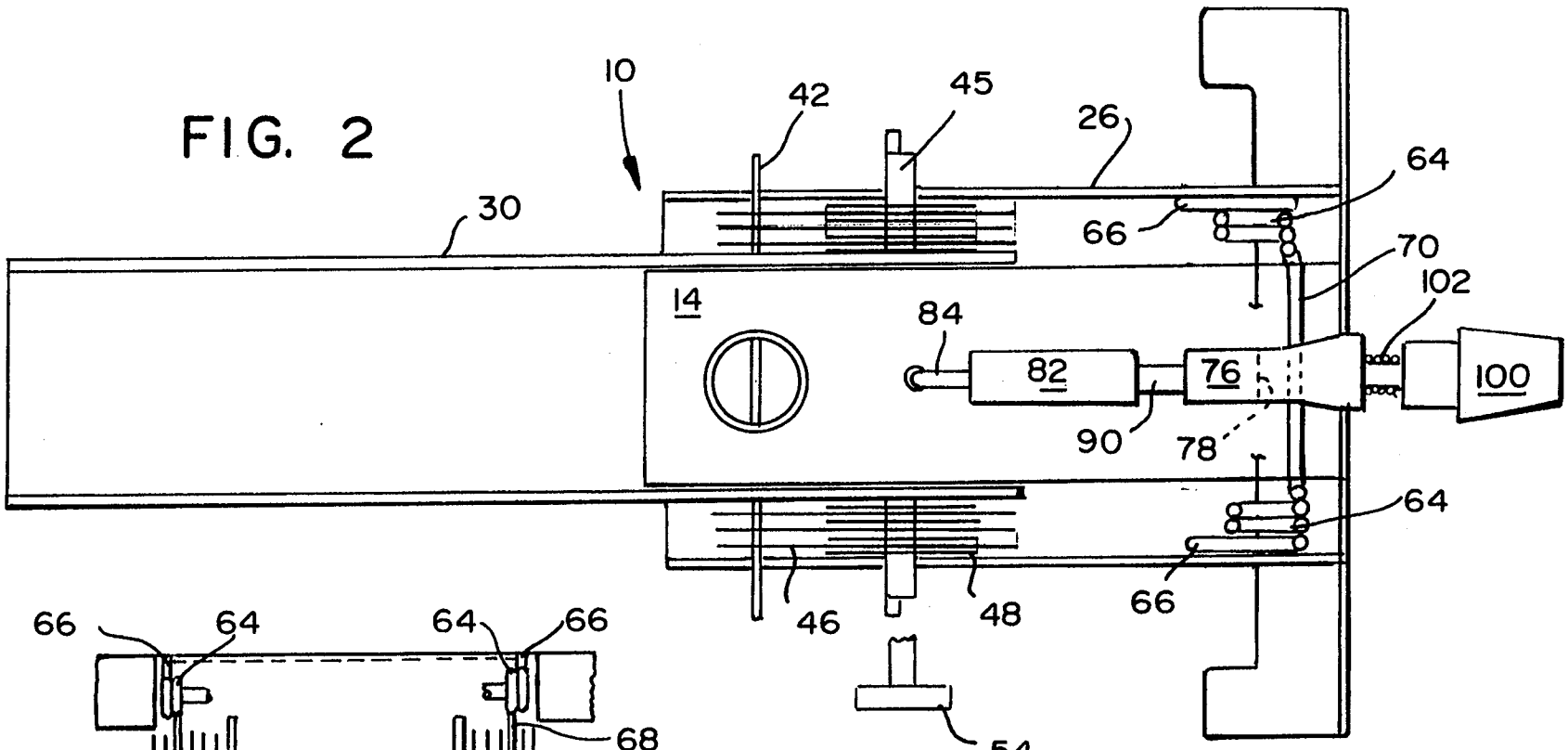
FIG. 2 is a bottom plan view of the structure and device illustrated in FIG. 1.
Figure 3:
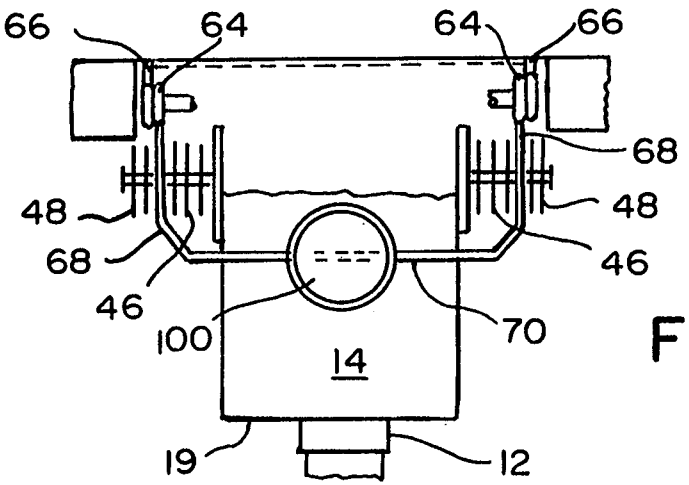
FIG. 3 is an end elevational view of the structure and device depiction shown in FIG. 1 as viewed from the right end of the last-mentioned FIGURE, certain of the FIG. 1 parts shown in FIG. 3 being broken away and others of the FIG. 1 parts not being illustrated as unnecessary for understanding of the invention.

The adjustment device 60 of the invention will be discussed next and with continuing reference to FIGS. 1–3. That device 60 includes a torsion spring 62 comprised of spring windings 64 concentric on shaft 28, and two pairs of spring legs integral with the windings, although it is possible that only one pair of spring legs need be used. The spring legs include first legs 66 at the opposite ends of the windings locating alongside the inner surface of the seat plate downward depending sides, these emanating from first windings at respective spring plural winding arrays. At opposite ends of the winding arrays, second spring legs 68 extending from the windings, these second spring legs being joined at lower tip ends by a cross joinder piece or stay 70.

The spring first legs 66 are engaged with the underside of the seat plate carrier, and the second spring legs 68 are connected (through the stay) to a holder 74. The holder 74 has a block like main body 76 and a finger piece 78 extends from the main body and is spaced therefrom so as to define a slot 80 in which the stay piece 70 is received as best seen in FIG. 1.

The holder 74 as seen in the drawings is supported from the base member by means of a mounting element 82 with a rod 84 therein that is fixed on the base member. A rod 90 also passes through block body 76, this rod 90 being rotatable and carrying treads 92 companion to threads 94 in the body 76 so that shaft rotation is used to advance the body toward the base member or away from it to correspondingly tighten or loosen the tensioning in the windings of the torsion spring to a maximum such winding and tensioning, or to a winding degree producing less tensioning than maximum. Greater or lesser winding tensioning provides greater or lesser urging of the force of spring legs 66 against the underside of the seat plate carrier and the degree to which downward pivoting of the seat plate carrier about the pivot 28 will occur.

A rotary handle 100 is fixed to rod 90 to effect rod rotation and a compression spring 102 acts against the handle to prevent its becoming slack on the mounting.

The maximum tensioning in the torsion spring is produced when the left or frontally projecting face 79 face of body 76 is urged into contact with a stop face 108 on the mounting element 82. With rotation of the rod 90 in a given direction, the body 76 advances leftwardly, the rod 90 having no advance because of the thread arrangement resulting in only body travel. A reverse or backward body travel stop also can be provided. One of ordinary skill in the art can select any of a number of ways to effect this. For example, the threads 94 on body 76 can terminate in the body at a location corresponding to where it is the main body should locate so that no device applied tension exists in the windings of spring 62.

Brief discussion now will be had regarding how the device is used. When the chair is unoccupied, the relative positioning of the seat element 38, its holder 26, the back rest frame 30 and the back rest 36 are as depicted in FIG. 1. The base member 14 is as was stated at the outset, a fixed position component. With the relative positioning aforementioned, spring 23 is at its normal urging of the seat plate carrier effect, i.e., it is at maximum spring extension. Similarly, torsion spring 62 is in its maximum urging of the seat plate carrier condition as well.

In this normal, unoccupied positioning, the back rest 36 is pitched forward to maximum extent and the seat element is generally horizontal.

For the user to occupy the chair comfortably, it will in almost all instances be required that adjustment of the relative positioning between the back rest and seat element be made by the user to effect this relative positioning to fit his or her own particular comfort. This adjustment will be made while the user is seated on the chair and user body weight and force is imposed on both the seat element and the back rest. All adjustments will of course involve pivoting of the back rest rearwardly to some degree.

In making the adjustment, the user first will operate the locking means 44 to orient it to unlocked condition. With that done, the user will manipulate or move his/her body to find the most comfortable back rest/seat element relationship. The locking means will then be oriented to lock the components in the selected positioning.

In the user set position, the back rest carrier generally will be pivoted to some downwardly inclined position while the seat element will be inclined downwardly at the rear but not as severely as the tilt of the back rest carrier. This is so because the user would be discomforted by the seat element being too elevated at the front end. With the seat occupied, both of springs 23 and 62 are under load. In the case of spring 23, the coils thereof undergo compression, and in the case of the spring 62, the windings are tightened.

If a person of relatively light weight and frame is occupying the seat, it is probable that the spring strengths of the spring 23 and of an unadjusted spring 62 will counter the pivoting of the seat plate carrier in downward direction so as to hold the seat element under the loading to near horizontal positioning. On the other hand, if a person of large size and weight is occupying the chair, the pivoting of the seat plate carrier will be such that the seat element/back rest relative positioning will be one of uncomfortable relationship and this because springs 23 and 62 cannot counterbias the heavier loading.

It is to provide against the last stated situation that the adjustment device 62 will be used. Bias of spring 23 cannot be altered but that of spring 62 can. Thus, the user can use device 62 by rotating handle 100 to increase the tensioning of the windings in spring 62 so that greater upward urging by it of the seat plate carrier results, and the pivoting of the seat plate carrier during back rest/seat element to set a given user required relationship therebetween is damped to keep it near horizontal.

Due to the progressive tightening character of the torsion spring 62, a tightening of the spring with rotation of handle 100 to a given setting will be effective to counter bias seat plate carrier pivoting to that desired and associated with proper seat element/back rest positioning for persons over a range of weights. For a heavy person the progressive tightening characteristic serves to enhance counter bias as weight increases. At the same time a relatively light person's weight will produce the pivoting of the seat plate character because spring bias due to the mentioned characteristic will be not be so great as to prevent that pivoting.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. In combination with a chair frame which includes a base member fixed in an upright position at a rear end thereof to a vertical mounting pedestal, the base member having a front tip end in which a first end of an elongated seat plate carrier is pivoted, an opposite second end of the seat plate carrier locating proximal the base member rear end, there being bias means engaged with the base member and with the seat plate carrier urging the seat plate carrier upwardly of the base member to a normally generally horizontal dispositioning of the seat plate member, a back rest carrier having first and second opposite ends, the first end of the back rest carrier being connected to the second end of the seat plate carrier such as to be pivotable about an axis parallel to that about which the seat plate carrier can pivot, the second end of the back rest carrier mounting a chair back rest, and locking means comprising cooperating components carried on the seat plate carrier and the back rest carrier and operable in a locked condition thereof to lock the seat plate carrier to the back rest carrier whereby relative positioning between the back rest and a seat element carried on the seat plate carrier is a set relationship, relative positioning between the back rest and seat element being alterable with the locking means in unlocked condition by pivoting the back rest carrier relative to the seat plate carrier and the seat plate carrier relative to the base member with a user imposed weight load presence acting on the seat element, an adjustment device for compensating for a difference in pivoting effect produced on the seat plate carrier by different ones of user weights in a range of such so that relative positioning between the back rest carrier and seat plate carrier can be effected to particular user comfort defined by the particular seat plate carrier and back rest carrier pivoting produced incident the particular user weight impositioned presence on the seat element, the adjustment device comprising a torsion spring having at least one winding about a shaft and at least one pair of oppositely directed legs connected to the winding, one leg of the pair being engaged with the seat plate carrier and acting in opposition to pivoting of the seat plate carrier toward the base member and a second leg of the pair being connected to a holder, the holder being mounted on a shaft passing therethrough, the shaft being rotatable in the holder with the holder and the shaft embodying cooperating means for moving the holder toward and away from the base member when the shaft is rotated in respective ones of two opposite directions thereby to correspondingly move the second leg in directions that produce respective greater or lesser tightening of the winding of the torsion spring whereby the said one leg of the torsion spring opposes seat plate holder pivoting toward the base member responsive to winding tightened condition, a rotary handle being fixed to an end of said shaft located remote from the base member, and a compression spring mounted on the shaft and interposed between the rotary handle and a main body part of the holder and engaging an end face of the rotary handle and an end face of the holder main body part.

2. The combination of claim 1 in which the torsion spring has plural windings and further includes at least one additional pair of oppositely directed legs, one leg of each pair engaging the seat plate carrier and a second leg of each pair being connected to the holder, there being a stay piece connecting tip ends of each second spring leg, the stay piece being captive on the holder.

3. The combination of claim 2 in which the holder includes a finger piece directed toward the base member, the finger piece being spaced from the main body part to define a slot receptive of the torsion spring stay piece.

4. The combination of claim 1 further comprising means for limiting travel movement of the holder in the direction of the base member.

5. The combination of claim 4 in which the limiting means comprises a stop element extending from the base member and presenting a stopping surface to a holder frontally projecting face.

* * * * *